US009120332B2

(12) United States Patent
Abe

(10) Patent No.: US 9,120,332 B2
(45) Date of Patent: Sep. 1, 2015

(54) TARGET TRANSPORTING DEVICE AND LIQUID EJECTING APPARATUS

(71) Applicant: Seiko Epson Corporation, Tokyo (JP)

(72) Inventor: Takahiro Abe, Shiojiri (JP)

(73) Assignee: Seiko Epson Corporation, Shiojiri-Shi (JP)

( * ) Notice: Subject to any disclaimer, the term of this patent is extended or adjusted under 35 U.S.C. 154(b) by 0 days.

(21) Appl. No.: 13/680,659

(22) Filed: Nov. 19, 2012

(65) Prior Publication Data

US 2013/0127943 A1 May 23, 2013

(30) Foreign Application Priority Data

Nov. 18, 2011 (JP) ..... 2011-252810

(51) Int. Cl.

| | |
|---|---|
| ***B41J 29/38*** | (2006.01) |
| ***B41J 2/01*** | (2006.01) |
| ***B41J 13/00*** | (2006.01) |
| ***B65H 20/02*** | (2006.01) |
| ***B65H 23/188*** | (2006.01) |
| ***B41J 15/16*** | (2006.01) |

(52) U.S. Cl.

CPC ..... *B41J 13/0009* (2013.01); *B41J 15/16* (2013.01); *B65H 20/02* (2013.01); *B65H 23/188* (2013.01); *B65H 2301/3422* (2013.01); *B65H 2301/5111* (2013.01); *B65H 2301/5143* (2013.01); *B65H 2404/143* (2013.01); *B65H 2404/692* (2013.01); *B65H 2511/11* (2013.01); *B65H 2511/112* (2013.01); *B65H 2801/12* (2013.01)

(58) Field of Classification Search

CPC ..... B41J 13/0009; B41J 11/42; B41J 11/007; B41J 15/005; B41J 15/16; B65H 20/02

USPC ..... 347/16, 104, 101

See application file for complete search history.

(56) References Cited

U.S. PATENT DOCUMENTS

| | | | |
|---|---|---|---|
| 7,147,316 | B2 | 12/2006 | Hayashi et al. |
| 2003/0128373 | A1 | 7/2003 | Hayashi et al. |
| 2003/0156150 | A1 | 8/2003 | Hayashi et al. |
| 2006/0158502 | A1 | 7/2006 | Hayashi et al. |

FOREIGN PATENT DOCUMENTS

| | | | |
|---|---|---|---|
| JP | 09-254370 | A | 9/1997 |
| JP | 2003-267591 | A | 9/2003 |
| JP | 2004-098550 | A | 4/2004 |
| JP | 4096740 | B2 | 6/2008 |

*Primary Examiner* — Jannelle M Lebron

(74) *Attorney, Agent, or Firm* — Nutter McClennen & Fish LLP; John J. Penny, Jr.; Taylor M. Coon

(57) ABSTRACT

A target transporting device includes a pair of transport rollers that applies a transport force to a continuous-form sheet toward a downstream side from an upstream side while pinching the continuous-form sheet; a guide member that applies a tension force to the continuous-form sheet being pinched by the pair of transport rollers toward the upstream side in a transport direction of the continuous-form sheet; and an image capturing unit that is disposed at a location upstream of the pair of transport rollers on a transport path of the continuous-form sheet so as to detect a transport amount of the continuous-form sheet to which the tension force is being applied by the guide member without contact.

7 Claims, 3 Drawing Sheets

TARGET TRANSPORTING DEVICE AND LIQUID EJECTING APPARATUS

BACKGROUND

1. Technical Field

The present invention relates to target transporting devices that transport targets and liquid ejecting apparatuses equipped with the stated target transporting devices.

2. Related Art

Ink jet printers that form images by ejecting liquid onto targets from liquid ejecting heads have been well known as one type of liquid ejecting apparatuses. Some of these printers include a sensor for detecting a transport amount of a target.

For example, a printer described in Japanese Patent No. 4,096,740 includes a motion sensor as such sensor. This motion sensor receives laser light reflected from a surface of a sheet, and a transport amount of the sheet is calculated based on a movement amount of an interference pattern (speckle pattern) that represents a shape of the surface of the sheet and is contained in the reflected laser light.

In the printer mentioned above, a pair of rollers that pinches a sheet and applies a transport force to the sheet is provided on a sheet transport path, and the motion sensor is provided in the vicinity of this roller pair. Accordingly, if strain is generated on a sheet fed out from the roller pair, a portion of the sheet to be detected by the motion sensor can deform in a rising manner. In this case, since a distance between the motion sensor and the sheet is varied, the motion sensor cannot clearly detect an interference pattern of laser light reflected from the sheet. Therefore, there has been a risk that the transport amount of the sheet cannot be detected with accuracy.

SUMMARY

An advantage of some aspects of the invention is to provide a target transporting device and a liquid ejecting apparatus that can detect a transport amount of a sheet with accuracy.

A target transporting device according to an aspect of the invention includes: a transporting unit that applies a transport force to a target toward a downstream side from an upstream side while pinching the target; a tension applying unit that applies a tension force to the target being pinched by the transporting unit toward the upstream side in a transport direction of the target; and a transport amount detecting unit that is disposed at a location upstream of the transporting unit on a transport path of the target so as to detect a transport amount of the target to which the tension force is being applied by the tension applying unit without contacting with the target.

According to the above configuration, the tension applying unit applies a tension force to a portion on which the transport amount detecting unit performs detection processing in the target that is pinched by the transporting unit. Accordingly, since a distance between the target and the transport amount detecting unit is kept constant, the transport amount of the target can be accurately detected by the transport amount detecting unit.

In the target transporting device according to the aspect of the invention, it is preferable for the tension applying unit to support the target while causing a portion of the target on the upstream side of the tension applying unit to hang down by gravity.

According to the above configuration, because the portion on the upstream side of the tension applying unit hangs down by gravity, a tension force generated by the target's own weight can be applied to the target being pinched by the transporting unit.

Further, in the target transporting device according to the aspect of the invention, it is preferable that a surface of the tension applying unit for supporting the target be formed in a carved shape curving along the transport direction of the target.

According to the above configuration, in a portion of the target on the upstream side of the target transporting unit, an area that is supported by the tension applying unit curves along the target transport direction. This strengthens the rigidity of the target in the width direction that intersects with the target transport direction. Accordingly, even if strain is generated on the target in the width direction at the time when the transporting unit pinches the target and applies a transport force thereto, deformation of the target is suppressed. This makes it possible for the transport amount detecting unit to detect the transport amount of the target more accurately.

Furthermore, in the target transporting unit according to the aspect of the invention, it is preferable that a portion of the target on which the transport amount detecting unit performs detection processing be located downstream of the tension applying unit on the transport path and be positioned at a height which is the same as or higher than that of the area supported by the tension applying unit.

According to the above configuration, a tension force generated by the target's own weight is applied to the above-mentioned portion of the target on which the transport amount detecting unit performs detection processing between the transporting unit and the tension applying unit. Accordingly, since a distance between the target and the transport amount detecting unit is kept constant, the transport amount of the target can be accurately detected by the transport amount detecting unit.

Still further, in the target transporting device according to the aspect of the invention, it is preferable that the transport amount detecting unit detect the transport amount of the target from the side of a surface of the target that is supported by the tension applying unit.

According to the above configuration, even if thickness of a target supported by the tension applying unit is changed, the distance between the target and the transport amount detecting unit does not change. Therefore, the transport amount detecting unit can precisely detect the transport amount of the target regardless of thickness of the target.

According to an aspect of the invention, it is preferable that a liquid ejecting apparatus include a liquid ejecting head that ejects liquid onto a target and the target transporting device in the aforementioned configuration.

According to the above configuration of the apparatus, the same effect can be obtained as that of the target transporting device of the invention.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment in which the invention is embodied in an ink jet printer, which is a type of liquid ejecting apparatus, will be described with reference to FIGS. 1 and 2.

Figure 1:
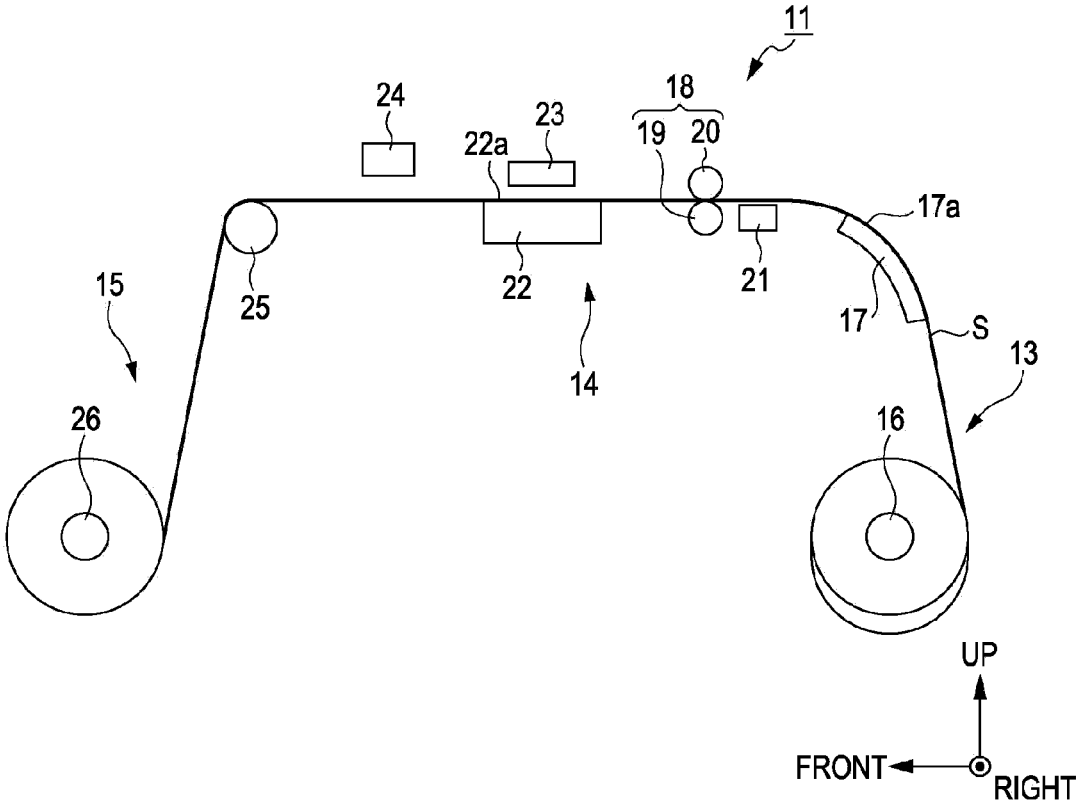
FIG. 1 is a schematic view illustrating a printer according to an embodiment of the invention.

As shown in FIG. 1, a printer 11 includes a feeding portion 13 that feeds out a continuous-form sheet S as a long target, a recording portion 14 that performs record processing by ejecting ink (liquid) onto the fed continuous-form sheet S, and a winding portion 15 that winds up the continuous-form sheet S on which the record processing has been performed by the recording portion 14.

That is, in an exemplary arrangement shown in FIG. 1, the feeding portion 13 is disposed at a location toward a rear side as the upstream side in the transport direction of the continuous-form sheet S, while the winding portion 15 is disposed at a location toward a front side as the downstream side in the transport direction. The recording portion 14 is disposed halfway between the feeding portion 13 and the winding portion 15 on a transport path.

A roll shaft 16 extending in the right-left direction (direction perpendicular to the paper plane of FIG. 1) is provided in a rotatable manner in the feeding portion 13. The continuous-form sheet S that has been wound up beforehand in a roll is supported on the roll shaft 16 so as to be capable of rotating with rotation of the roll shaft 16. In other words, the continuous-form sheet S is fed out from the roll shaft 16 to the downstream side in the transport direction by the rotation of the roll shaft 16.

At a position on the diagonally upward front side of the roll shaft 16, there is provided a guide member 17 that winds the continuous-form sheet S fed out from the roll shaft 16 toward the upper side thereupon from the lower rear side thereof, and guides the continuous-form sheet S to the recording portion 14 which is provided ahead of the guide member 17. The guide member 17 is formed in an arc shape that curves projecting to an upper-side direction, which is opposite to the direction of gravity, along the transport direction of the continuous-form sheet S. Then, the continuous-form sheet S having been fed out from the roll shaft 16 is supported from the lower side thereof by the guide member 17 in a state where the continuous-form sheet S is wound on an outer surface 17*a*, which is an outer side along the curving direction of the guide member 17, from the lower rear side of the outer surface 17*a*. Note that a portion of the continuous-form sheet S on the upstream side of the guide member 17 in the transport direction hangs downward from the lower end of the outer surface 17*a* of the guide member 17 by gravity. Therefore, part of the continuous-form sheet S that has been wound around the roll shaft 16 is unwound from the roll shaft 16 and hangs down due to its own weight to the lower side of the roll shaft 16.

A pair of transport rollers 18 is provided as the transporting unit at a position ahead of the guide member 17, i.e., on the downstream side of the guide member 17 in the transport direction of the continuous-form sheet S. The pair of transport rollers 18 is configured of a drive roller 19 and a slave roller 20. The slave roller 20 is rotated driven by driving rotation of the drive roller 19 in a state where the continuous-form sheet S is pinched by the drive roller 19 and the slave roller 20, so that a transport force toward the recording portion 14 is applied to the continuous-form sheet S. In addition, an image capturing unit 21 is disposed as the transport amount detecting unit between the guide member 17 and the pair of transport rollers 18 on the transport path of the continuous-form sheet S so as to detect a transport amount of the continuous-form sheet S without contacting therewith. That is to say, the image capturing unit 21 is disposed at a position upstream of the pair of transport rollers 18 on the transport path of the continuous-form sheet S.

Note that the uppermost area of the circumferential surface of the drive roller 19 and the lowermost area of the circumferential surface of the slave roller 20, which are the portions of the pair of transport rollers 18 that pinch the continuous-form sheet S, are positioned at approximately the same height as that of the upper end of the outer surface 17*a* of the guide member 17. Through this, a portion of the continuous-form sheet S on which the image capturing unit 21 performs detection processing is arranged horizontally between the guide member 17 and the pair of transport rollers 18 so that the paper plane thereof is parallel to a horizontal plane, and is positioned at approximately the same height as that of the upper end of the outer surface 17*a* of the guide member 17.

A support platform 22 capable of supporting a continuous-form sheet S is provided in the recoding portion 14. Further, a line head-type recording head 23 as the liquid ejecting head is disposed at a position opposed to the support platform 22 in the recording portion 14. The lower surface of the recording head 23 is a nozzle formation surface where a plurality of nozzles for ejecting ink are opened (not shown). The recording head 23 horizontally extends in a direction perpendicular to the transport direction of the continuous-form sheet S, and the length of the recoding head 23 in the lengthwise direction is so determined as to correspond to the maximum width of the continuous-form sheet S. Then, the recording head 23 performs record processing by ejecting ink onto the continuous-form sheet S which is pinched and transported by the pair of transport rollers 18.

A heater 24 that heats and fixes ink ejected from the recording head 23 onto a continuous-form sheet S is provided at a position ahead of the recording head 23, i.e., on the downstream side of the recording head 23 in the transport direction of the continuous-form sheet S. Further, a relay roller 25 is provided at a position ahead of the support platform 22, i.e., on the downstream side of the heater 24 in the transport direction of the continuous-form sheet S, while the relay roller 25 being opposed to the guide member 17 with the support platform 22 therebetween with respect to the front-rear direction. Note that the top of the circumferential surface of the relay roller 25 is positioned at approximately the same height as that of the upper end of the outer surface 17*a* of the guide member 17 and a support surface 22*a* of the support platform 22. With this, the continuous-form sheet S to which the transport force is applied from the upstream side toward the downstream side by the pair of transport rollers 18, is transported sliding on the support surface 22*a* to the frond side, i.e., to the downstream side. Then, the continuous-form sheet S is wound on the relay roller 25 from the upper rear side thereof so that the transport direction of the continuous-form sheet S is changed from the horizontal direction to a diagonally downward front direction, and is transported to the winding portion 15.

In the winding portion 15, a winding shaft 26 is so provided as to be capable of driving in a rotatable manner on the diagonally downward front side of the relay roller 25. A leading edge of the continuous-form sheet S, which is the end of the continuous-form sheet S on the downstream side in the transport direction, is wound upon the winding shaft 26 with the rotational drive of the winding shaft 26.

Next, the image capturing unit 21 will be described in detail below.

Figure 2:
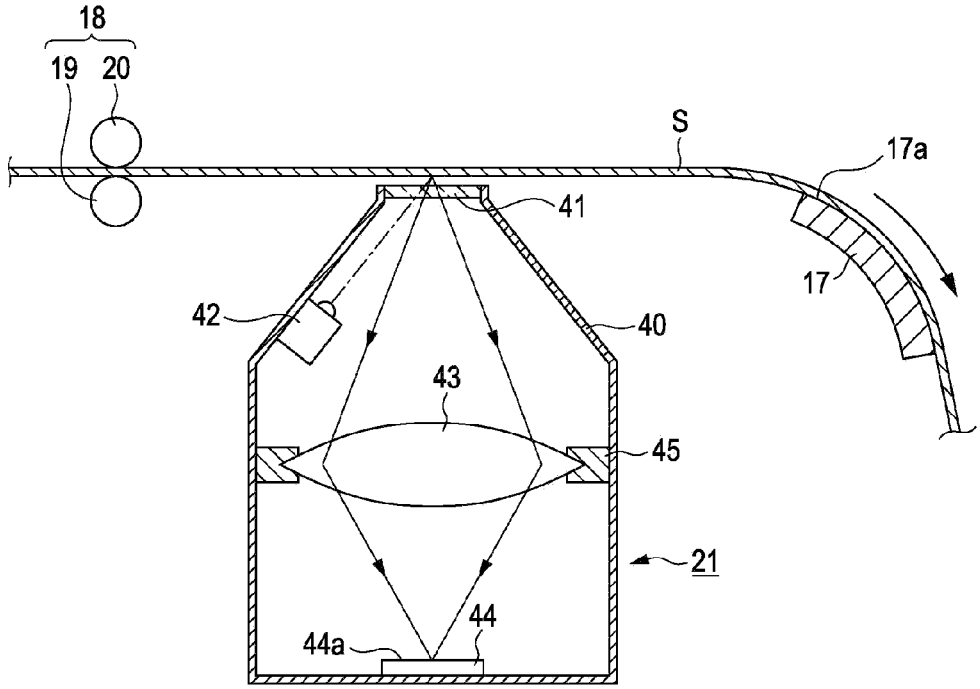
FIG. 2 is a cross-sectional view of an image capturing unit.

As shown in FIG. 2, a case 40 that configures an outer housing of the image capturing unit 21 includes a transparent glass 41 attached to the tip (upper end) of the case 40, which is formed in a shape of a cylinder with a circular truncated cone thereon. The transparent glass 41 faces a continuous-form sheet S in the up-down direction with a space therebetween, and does not make contact with the continuous-form sheet S. Meanwhile, in the case 40, a light emitting portion 42 configured of a light-emitting diode (LED), for example, is provided. The light emitting portion 42 is anchored to an inner wall surface of the case 40 at an orientation angle at which light can be emitted toward the transparent glass 41. Further, a focusing lens 43 is provided in the case 40. The light emitted from the light emitting portion 42 passes through the transparent glass 41, reflects off the reverse of the continuous-form sheet S, again passes through the transparent glass 41, and enters the case 40; the reflected light that has entered the case 40 is collected by the focusing lens 43. In addition, in the case 40, there is provided an image capturing element 44 that includes an image capturing surface 44*a* on which an image on the reverse of the continuous-form sheet S whose reflected light is collected by the focusing lens 43 is captured. The image capturing element 44 is configured of, for example, a two-dimensional image sensor. It is to be noted that the focusing lens 43 is held with a holding member 45 at an appropriate height such that the image on the reverse of the continuous-form sheet S can be captured on the image capturing surface 44*a* of the image capturing element 44. Then, the image capturing unit 21 takes an image of texture (paper plane pattern) of the continuous-form sheet S from the side of a surface of the continuous-form sheet S supported by the guide member 17, and calculates a transport amount of the continuous-form sheet S per unit time by comparing the two images taken consecutively at a constant time interval.

Hereinafter, action of the printer 11 configured as described above will be described, specifically focusing on the action when the image capturing unit 21 detects a transport amount of a continuous-form sheet S.

Since a portion of the continuous-form sheet S on the upstream side of the guide member 17 in the transport direction hangs downward from the lower end of the outer surface 17*a* of the guide member 17 by gravity, a tension force toward the upstream side of the transport direction is exerted on the continuous-form sheet S pinched by the pair of transport rollers 18 due to the weight of the continuous-form sheet S itself. In other words, in this embodiment, the guide member 17 functions as a tension applying member that causes a tension force toward the upstream side in the transport direction of the continuous-form sheet S to be exerted on the continuous-form sheet S pinched by the pair of transport rollers 18. Through this, a portion of the continuous-form sheet S on which the image capturing unit 21 performs detection processing is made to be stretched without sag between the pair of transport rollers 18 and the guide member 17. As a result, an appropriate distance between the continuous-form sheet S and the image capturing surface 44*a* of the image capturing element 44 is maintained in an optical axis direction of the reflection light that is reflected from the continuous-form sheet S. Accordingly, since an image of texture of the continuous-form sheet S is clearly captured on the image capturing surface 44*a* of the image capturing element 44, a transport amount of the continuous-form sheet S can be accurately calculated based on a movement amount of the texture of the continuous-form sheet S obtained from a result of image capturing performed by the image capturing element 44.

According to the above embodiment, the following effects can be obtained.

1. The guide member 17 applies a tension force to a portion on which the image capturing unit 21 performs detection processing in the continuous-form sheet S that is pinched by the pair of transport rollers 18. Through this, a distance between the continuous-form sheet S and the image capturing unit 21 is kept constant, thereby making it possible for the image capturing unit 21 to detect a transport amount of the continuous-form sheet S with accuracy.

2. A portion of the continuous-form sheet S on the upstream side of the guide member 17 in the transport direction hangs downward by gravity, which makes it possible to apply a tension force to the continuous-form sheet S being pinched by the pair of transport rollers 18 by the weight of the continuous-form sheet S itself.

3. In a portion of the continuous-form sheet S on the upstream side of the pair of transport rollers 18, an area that is supported by the guide member 17 curves along the transport direction of the continuous-form sheet S. This strengthens the rigidity of the continuous-form sheet S in the width direction that intersects with the transport direction of the continuous-form sheet S. Therefore, even if strain is generated on the continuous-form sheet S in the width direction at the time when the pair of transport rollers 18 pinches the continuous-form sheet S and applies a transport force thereto, deformation of the continuous-form sheet S is suppressed, thereby making it possible for the image capturing unit 21 to detect the transport amount of the continuous-form sheet S more accurately.

4. A portion of the continuous-form sheet S on which the image capturing unit 21 performs detection processing is located downstream of the guide member 17 in the transport direction of the continuous-form sheet S and is positioned at a height which is the same as or higher than that of an area of the continuous-form sheet S supported by the guide member 17. With this, a tension force generated by the weight of the continuous-form sheet S itself is made to act on the above-mentioned portion of the continuous-form sheet S on which the image capturing unit 21 performs detection processing between the pair of transport rollers 18 and the guide member 17. Accordingly, a distance between the continuous-form sheet S and the image capturing unit 21 is kept constant, thereby making it possible for the image capturing unit 21 to accurately detect the transport account of the continuous-form sheet S.

5. The image capturing unit 21 detects the transport amount of a continuous-form sheet S from the side of a surface of the continuous-form sheet S that is supported by the guide member 17. Accordingly, even if thickness of a continuous-form sheet S supported by the guide member 17 is changed, the distance between the continuous-form sheet S and the image capturing unit 21 does not change. This makes it possible for the image capturing unit 21 to precisely detect the transport amount of the continuous-form sheet S regardless of thickness of the continuous-form sheet S.

6. A portion of the continuous-form sheet S on which the image capturing unit 21 performs detection processing is located at a position opposite to the recording head 23 in the transport direction of the continuous-form sheet S with the pair of transport rollers 18 therebetween. Therefore, even if the continuous-form sheet S absorbs ink ejected from the recording head 23 and swells so as to be expanded, the above-mentioned portion of the continuous-form sheet S on which the image capturing unit 21 performs detection processing is kept in a state of being stretched without sag. Accordingly, since the distance between the continuous-form sheet S and the image capturing unit 21 is kept constant, it is possible for the image capturing unit 21 to precisely detect the transport amount of the continuous-form sheet S.

7. A portion of the continuous-form sheet S on which the image capturing unit 21 performs detection processing is located at a position opposite to the heater 24 in the transport direction of the continuous-form sheet S with the pair of transport rollers 18 therebetween. Therefore, even if the continuous-form sheet S expands by being heated by the heat from the heater 24, the above-mentioned portion of the continuous-form sheet S on which the image capturing unit 21 performs detection processing is kept in a state of being stretched without sag. Accordingly, since the distance between the continuous-form sheet S and the image capturing unit 21 is kept constant, it is possible for the image capturing unit 21 to precisely detect the transport amount of the continuous-form sheet S.

The aforementioned embodiment may be changed to other embodiments as follows.

In the aforementioned embodiment, the image capturing unit 21 may detect a transport amount of the continuous-form sheet S from the opposite side of the surface of the continuous-form sheet S which is supported by the guide member 17.

In the aforementioned embodiment, the guide member 17 may be disposed downstream of the pair of transport rollers 18, and a portion of the continuous-form sheet S on the upstream side of the guide member 17 may be set as a detection area on which the image capturing unit 21 performs detection processing.

Figure 3A:
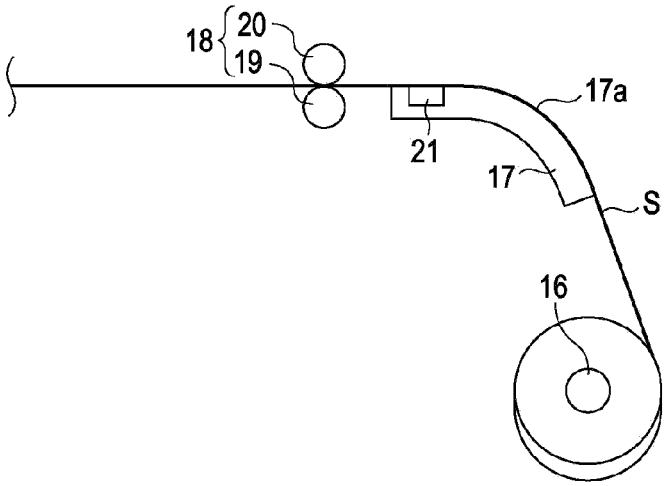
FIGS. 3A through 3C are schematic views illustrating principal portions of printers according to other embodiments of the invention.

In the aforementioned embodiment, the image capturing unit 21 may be embedded in the uppermost portion of the outer surface 17*a* of the guide member 17 so that the guide member 17 and the image capturing unit 21 may be arranged overlapping each other in the transport direction of the continuous-form sheet S, as shown in FIG. 3A.

In the aforementioned embodiment, the outer surface 17*a* of the guide member 17 may be formed in a shape that curves in a projecting manner to a lower-side direction, i.e., the direction of gravity.

Figure 3B:
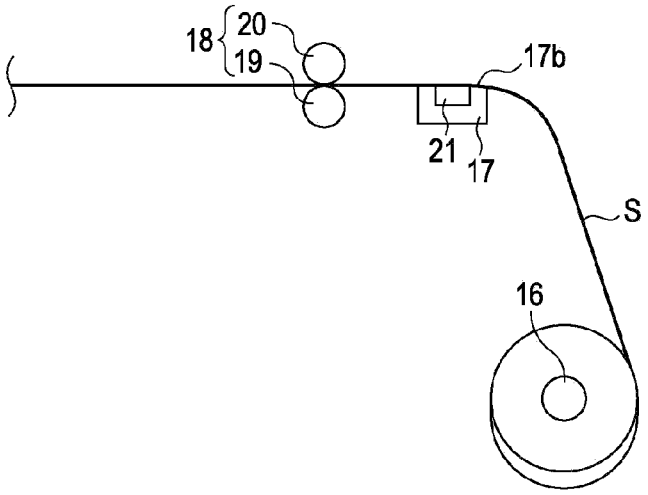

In the aforementioned embodiment, the outer surface 17*a* of the guide member 17 may not be necessarily needed to have a curved shape. For example, as shown in FIG. 3B, the guide member 17 may be formed in a rectangular plate shape, and a continuous-form sheet S fed out from the roll shaft 16 may be wound on a flat upper surface 17*b* of the guide member 17 from above. In this configuration, a portion of the continuous-form sheet S on the upstream side of the guide member 17 hangs downward by gravity from the rear end of the upper surface 17*b* of the guide member 17. Accordingly, a tension force toward the upstream side of the transport direction acts on the continuous-form sheet S pinched by the pair of transport rollers 18 due to the weight of the continuous-form sheet S itself.

Figure 3C:
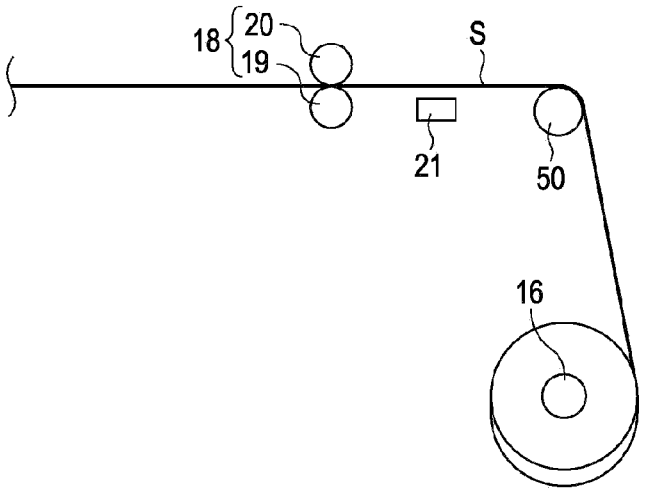

In the aforementioned embodiment, in place of the guide member 17, as shown in FIG. 3C, a relay roller 50 may be provided on which a continuous-form sheet S fed out from the roll shaft 16 is wound. In this configuration, a portion of the continuous-form sheet S on the upstream side of the relay roller 50 in the transport direction hangs downward by gravity. Accordingly, a tension force toward the upstream side of the transport direction acts on the continuous-form sheet S pinched by the pair of transport rollers 18 due to the weight of the continuous-form sheet S itself.

In the aforementioned embodiment, a tension force toward the upstream side of the transport direction may be caused to act on a continuous-form sheet S by rotationally driving the roll shaft 16 in a direction of winding up the continuous-form sheet S. Further, a tension force toward the upstream side of the transport direction may be caused to act on a continuous-form sheet S by making the roll shaft 16 have rotational resistance. Furthermore, a tension force toward the upstream side of the transport direction may be caused to act on a continuous-form sheet S by providing a friction plate between the roll shaft 16 and the pair of transport rollers 18 on the transport path of the continuous-form sheet S so that a friction force is given by the friction plate making contact with the continuous-form sheet S in a sliding manner.

In the aforementioned embodiment, the transport amount detecting unit that detects a transport amount of a continuous-form sheet S without contact is not limited to an optical sensor, and it may be an acoustic wave sensor, for example, that makes an acoustic wave be incident on a continuous-form sheet S so as to detect the transport amount of the continuous-form sheet S based on a change in frequency of the acoustic wave reflected from the continuous-form sheet S.

In the aforementioned embodiment, the transporting unit that pinches a continuous-form sheet S and applies a transport force thereto is not limited to a pair of rollers, and it may be configured of, for example, an endless transport belt that moves in a revolving manner while supporting the continuous-form sheet S, and a slave roller that is rotationally driven while pinching the continuous-form sheet S with the transport belt.

In the aforementioned embodiment, the target is not limited to a long target wound up in a roll, and a single-sheet target may be employed instead.

In the aforementioned embodiment, a material of the target is not limited to paper, and a fabric, a resin film, a resin sheet, a metal sheet or the like may be employed for the target.

In the aforementioned embodiment, the invention may be embodied in a serial-type or lateral-type printer as the printer 11.

In the aforementioned embodiment, the liquid ejecting apparatus is embodied in the ink jet printer 11, but it may be embodied in a liquid ejecting apparatus that ejects or discharges a liquid aside from ink as well. The invention can also be applied in various types of liquid ejecting apparatuses including liquid ejecting heads that discharge minute liquid droplets, and the like. Note that "droplet" refers to a state of the liquid discharged from the liquid ejecting apparatus, and is intended to include granule forms, teardrop forms, and forms that pull tails in a string-like form therebehind. Furthermore, the "liquid" referred to here can be any material that is capable of being ejected by the liquid ejecting apparatus. For example, any substance can be used as long as the substance is in a state of liquid phase, including liquids having high or low viscosity, and fluidal materials such as sol, gel water, other inorganic solvents, organic solvents, solutions, liquid resin, and liquid metal (metallic melt); furthermore, in addition to liquids as a state of a substance, liquids in which the particles of a functional material made of solid matter such as pigments, metal particles or the like are dissolved, dispersed or mixed in a solvent, are included as well. Ink as described in the aforementioned embodiment, liquid crystal and the like can be given as a representative example of the liquid. Here, "ink" includes general water-based ink, oil-based ink, as well as various types of liquid compositions such as gel inks, hot-melt inks and so on. The following are specific examples of liquid ejecting apparatuses: liquid ejecting apparatuses that eject liquids including materials such as electrode materials, coloring materials and so on in a dispersed or dissolved state for use in the manufacture and so on of, for example, liquid-crystal displays, EL (electroluminescence) displays, surface light emission displays, and color filters; liquid ejecting apparatuses that eject bioorganic substances used in the manufacture of biochips; liquid ejecting apparatuses that are used as precision pipettes and eject liquids to be used as samples; printing apparatuses; micro-dispensers; and so on. Furthermore, a liquid ejecting apparatus that performs pinpoint ejection of lubrication oils into the precision mechanisms of clocks, cameras and the like, a liquid ejecting apparatus that ejects a transparent resin liquid such as an ultraviolet curing resin or the like onto a substrate so as to form a miniature hemispheric lens (optical lens) used in an optical communication element and the like, or a liquid ejecting apparatus that ejects an etching liquid of such as acid or alkali onto a substrate or the like for etching may be employed. The invention can be applied to any type of these liquid ejecting apparatuses.

In the aforementioned embodiment, the target transporting device is not limited to a device included in a recording apparatus that performs record processing on a target, and may be a target transporting device that is included in various kinds of apparatuses that perform arbitrary processing on a target.

The entire disclosure of Japanese Patent Application No. 2011-252810, filed Nov. 18, 2011 is expressly incorporated by reference herein.

What is claimed is:

1. A target transporting device comprising:

a transporting unit that applies a transport force to a target toward a downstream side from an upstream side while pinching the target;

a tension applying unit that applies a tension force to the target being pinched by the transporting unit toward the upstream side in a transport direction of the target; and a transport amount detecting unit that is disposed at a location upstream of the transporting unit on a transport path of the target so as to detect a transport amount of the target to which the tension force is being applied by the tension applying unit, wherein the transport amount detecting unit does not contact the target, wherein the tension applying unit supports the target while causing a portion of the target on the upstream side of the tension applying unit to hang down by gravity wherein a surface of the tension applying unit that supports the target is formed in a carved shape curving along the transport direction of the target.

2. The target transporting device according to claim 1, wherein a portion of the target on which the transport amount detecting unit performs detection processing is located downstream of the tension applying unit on the transport path and is positioned at a height which is the same as or higher than that of an area of the target supported by the tension applying unit.

3. The target transporting device according to claim 1, wherein the transport amount detecting unit detects the transport amount of the target from the side of a surface of the target that is supported by the tension applying unit.

4. A liquid ejecting apparatus comprising: a liquid ejecting head that ejects liquid onto a target; and the target transporting device according to claim 1.

5. A liquid ejecting apparatus comprising: a liquid ejecting head that ejects liquid onto a target; and the target transporting device according to claim 2.

6. A liquid ejecting apparatus comprising: a liquid ejecting head that ejects liquid onto a target; and the target transporting device according to claim 3.

7. The target transporting device according to claim 1, wherein, the transporting unit comprises a pair of rollers, the tension applying unit comprises a support, and, the transport amount detecting unit comprises a sensor.

* * * * *